United States Patent [19]

Saunders

[11] 4,346,580

[45] Aug. 31, 1982

[54] MANUFACTURE OF LIGHTWEIGHT DRAWN AND IRONED CAN BODIES

[75] Inventor: William T. Saunders, Weirton, W. Va.

[73] Assignee: National Steel Corporation, Pittsburgh, Pa.

[21] Appl. No.: 181,467

[22] Filed: Aug. 26, 1980

[51] Int. Cl.[3] ..... B21D 45/00

[52] U.S. Cl. ..... 72/344; 72/349

[58] Field of Search ..... 72/344, 345, 347, 349

[56] References Cited

U.S. PATENT DOCUMENTS

| | | | |
|---|---|---|---|
| 3,360,157 | 12/1967 | Bolt et al. | 220/64 |
| 3,406,554 | 10/1968 | Frankenberg | 72/333 |
| 3,733,880 | 5/1973 | Hansson | 72/344 |
| 3,855,862 | 12/1974 | Moller | 72/334 |
| 3,937,046 | 2/1976 | Saunders | 72/349 X |
| 3,937,047 | 2/1976 | Saunders | 72/344 |
| 3,945,231 | 3/1976 | Imazu et al. | 72/349 |
| 3,972,217 | 8/1976 | Misonoo | 72/349 |
| 3,990,289 | 11/1976 | Widmann | 72/345 |
| 4,095,452 | 6/1978 | Cruz | 72/344 |
| 4,193,279 | 3/1980 | Maeder | 72/344 |

*Primary Examiner*—Leon Gilden

*Attorney, Agent, or Firm*—Shanley, O'Neil and Baker

[57] ABSTRACT

Improved ironing mandrel and structure for drawing and ironing can bodies from lightweight flat rolled sheet metal while facilitating stripping from the ironing mandrel and providing desired flanging metal are disclosed. The exterior surface of the mandrel is provided with a uniform-taper transition zone contiguous to the trim height for a can body being formed such that sidewall metal thickness increases uniformly above the main body portion of the can body and expires along the tapered surface of the transition zone. The tapered surface extends beyond formed can body height so that stripping means approach the open end of an ironed can body along a portion of the mandrel having a smaller diameter than the interior diameter of the mandrel mounted can body.

8 Claims, 4 Drawing Figures

MANUFACTURE OF LIGHTWEIGHT DRAWN AND IRONED CAN BODIES

This invention is concerned with improved ironing of sheet metal can bodies and with facilitating removal of a can body from a male plunger after sidewall ironing.

Two-piece beverage containers include a unitary can body made by drawing flat rolled sheet metal into a shallow depth cup followed by sidewall ironing to reduce sidewall metal thickness and elongate the sidewall to a height in excess of that required for the completed container. Such excess height allows for trimming of metal at the open end of the can body to provide a uniform height can body for addition of a closure.

Because of the reduction in sidewall thickness, the ironed can body conforms to the ironing mandrel such that considerable force is required for removal. In addition to reducing or eliminating probability of damage to the can body during such removal, the invention provides methods and means for ironing lightweight unitary can bodies having improved flanging metal characteristics.

Flanging metal of increased wall thickness at the open end of a can body is of interest in order to avoid or reduce edge cracking during formation of the chime seam used for adding a closure at the open end of a drawn and ironed can body. But, increasing metal thickness at the open end of a can body can make stripping more difficult since the added flanging metal thickness reduces the internal diameter of the can body at its open end.

Relatively heavy gage sheet metal has been used to better withstand mechanically-applied stripping force. For example, tinplated steel of at least 107#/bb (0.0118" thickness) has been used in commercial practice prior to the present invention for drawing and ironing can bodies for the standard pressurized beverage container having a height of about five inches. Notwithstanding use of 107∩/bb flat rolled steel and heavier sheet metal, close dimensional tolerances have had to be maintained for the stripper means used with prior art ironing mandrels.

The present invention enhances flanging metal formation, with minimum trim wastage while facilitating sidewall ironing and stripping of lightweight sheet metal can bodies from the ironing mandrel; lightweight can bodies for beverage containers can be made from flat rolled steel of about 85∩/bb (0.0094") and lighter gage, and from aluminum of about 0.0135" gage with the invention.

Figure 1:
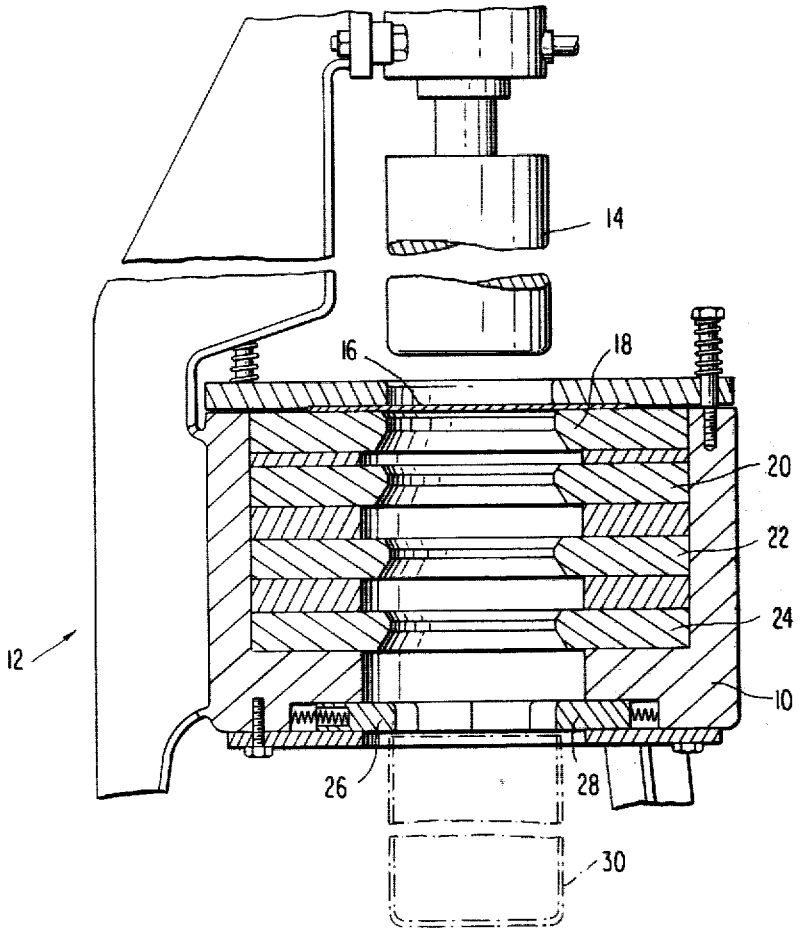
FIG. 1 (PRIOR ART)
Figure 2:
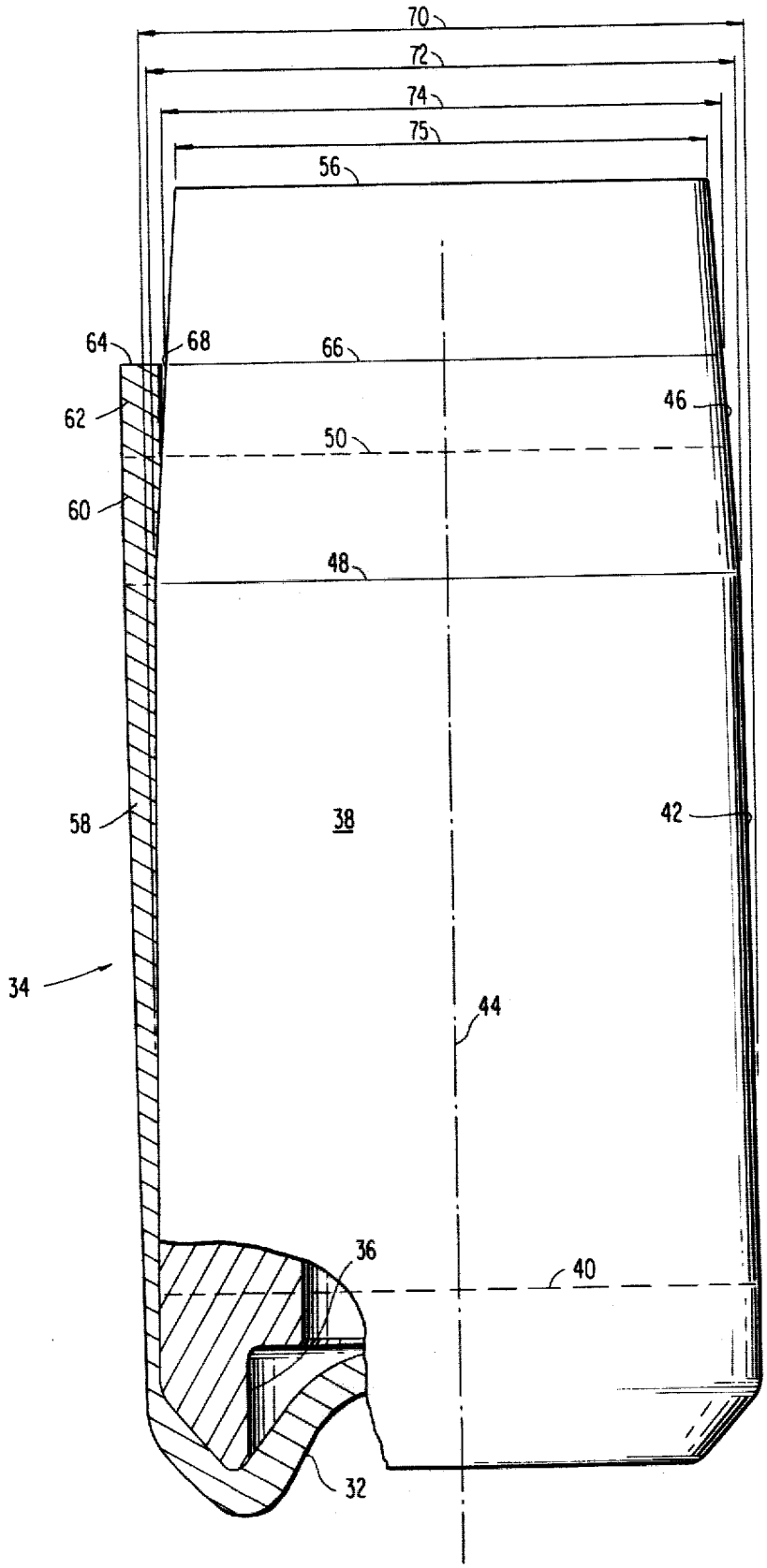
Figure 4:
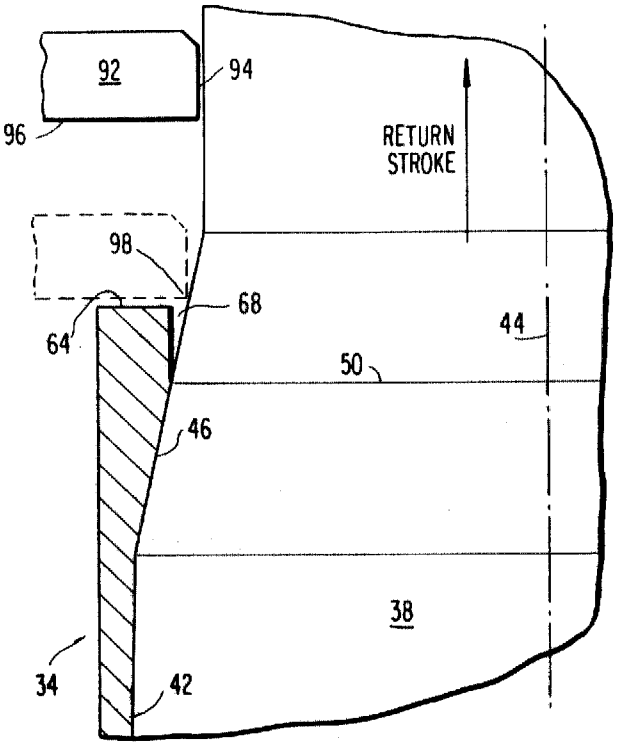
Figure 3:
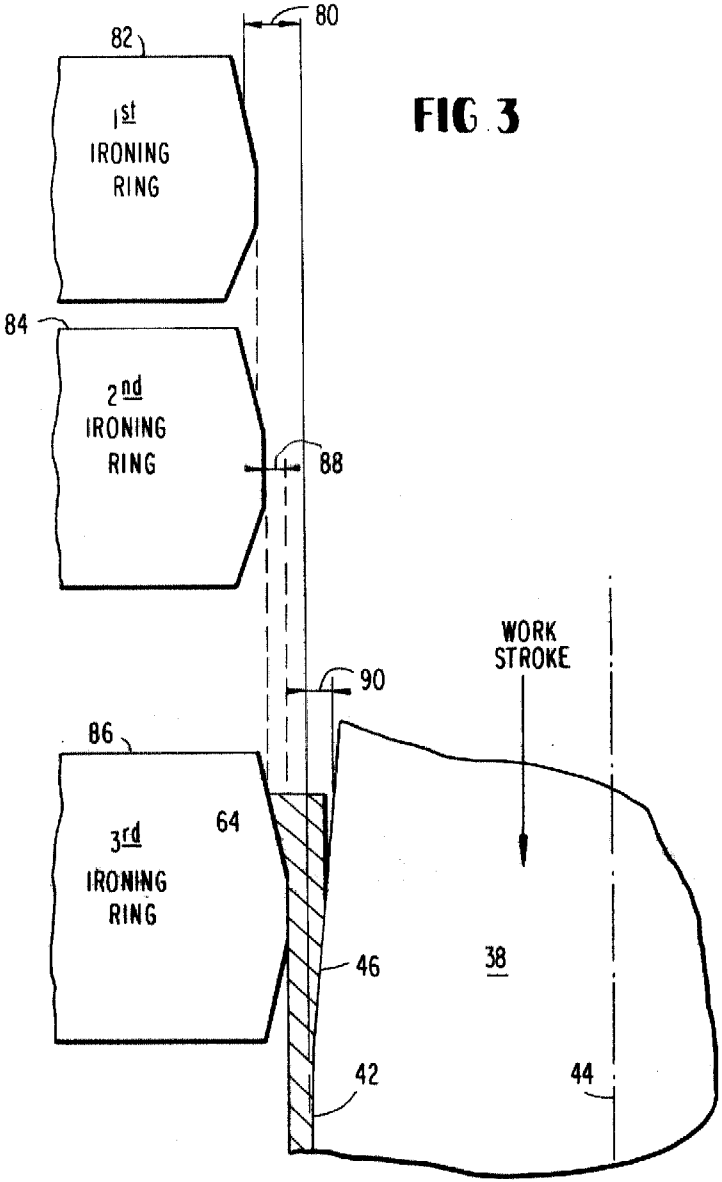

Other advantages and contributions of the invention are considered in a more detailed description of apparatus shown in the accompanying drawings; in these drawings:

FIG. 1 presents a general arrangement view, with portions in cross section, of a prior art arrangement for drawing and ironing apparatus;

FIG. 2 is a view in elevation, with portions cut away, of an ironing mandrel embodying the invention and showing an ironed sidewall can body with a portion in cross section;

FIG. 3 is a schematic cross-sectional partial view of apparatus embodying the invention showing interrelationship of mandrel and ironing ring dimensions in accordance with the invention; and FIG. 4 is an enlarged cross-sectional view of a portion of apparatus showing an interrelationship of the ironing mandrel and mechanical stripping means, in accordance with the invention, which facilitates stripping.

In the standard arrangement for drawing and ironing apparatus of FIG. 1, die carrier 10 forms part of a press 12. Male plunger 14 is driven downwardly during its work stroke forming sheet metal blank 16 into a cup-shaped article in drawing die 18. Sidewall metal of the cup is then ironed during passage through ironing rings 20, 22, and 24. On the return stroke of plunger 14, stripping means 26, 28 contact the upper edge of can body 30 to mechanically assist in removing the can body from plunger 14. A similar arrangement of the apparatus of the present invention can be used for drawing, ironing, and removing can bodies.

With the improved ironing mandrel configuration of FIG. 2, mechanical stripping means extend "inside" the diameter of the sheet metal can body at its open end during relative movement of the stripping means along the external surface of the mandrel in approaching the open end of the formed can body. That is, the surface of mechanical stripping means which contact the open-end edge of the formed can body extend radially inwardly toward the central longitudinal axis of the mandrel to a smaller diameter portion of the mandrel than that existing at the open end of the formed can body.

This contribution of the invention improves edge metal contact so that slippage of stripping fingers off the open end of a can body, because of thinness of the edge metal or because of wear of the mechanical stripping means, is avoided. As a result, concern for maintenance of dimensional tolerance requirements for the stripping fingers is substantially reduced and other measures of the prior art to augment the stripping finger action are not required.

As shown in the partially cut-away portion of FIG. 2, bottom wall profile 32 for can body 34 is established in part by the configuration of mandrel bottom wall structure 36, located at the work output (terminal) end of ironing mandrel 38, which cooperates with other means in shaping the bottom wall. Conventional bottom wall profiles, of the recessed dome type shown, can be provided with the light gage materials set forth above.

In accordance with the invention, the main body portion of an ironing mandrel can be reverse tapered, i.e. have a configuration with its largest diameter contiguous to the work output (terminal) end of the mandrel rather than contiguous to the work input (supported) end of the mandrel. Use of this reverse taper feature can aid stripping by enabling increased access for, and holding of, lubricant between the inner surface of the can body and the exterior surface of the mandrel. While this reverse taper feature is preferred, and is shown in the embodiment of the ironing mandrel of FIG. 2, the invention enables use of ironing mandrels in which the main body portion is cylindrical or conventionally tapered, that is, with the mandrel diameter decreasing toward the work output end.

In the embodiment of FIG. 2, the largest diameter portion of ironing mandrel 38 is located in a plane perpendicular to the longitudinal axis of the mandrel represented by broken line 40; this plane is located contiguously to the work output end 36 of the mandrel 38.

The exterior configuration of main body portion 42 of the mandrel of FIG. 2 includes a slight taper toward the central longitudinal axis 44. This slight main body taper begins at the largest diameter plane represented by line 40 and extends to the start of a transition zone 46 which is located toward the work input end of the mandrel. Transition zone 46 starts at a plane (perpendicular to axis 44) represented by line 48.

The configuration of the mandrel beyond line 48 in the direction of the work input end comprises an important aspect of the invention. The transition zone surface 46 is uniformly tapered toward the central longitudinal axis 44 in extending toward the work input end of the mandrel. Flanging metal is formed with uniformly increasing thickness in this transition zone during the ironing process; also, ironing terminates and sidewall metal expires in the transition zone 46 at a location where the taper continues.

After sidewall ironing of the can body and removal from the ironing mandrel, the formed can body is trimmed to a predetermined height referred to as the trim height. For a formed can body mounted on mandrel 38, the trim height would fall in the plane of line 50.

A significant contribution of the invention is the extension of the taper of transition zone surface 46 beyond trim plane height and beyond the can height formed on the mandrel. Preferably, for ease of manufacturing purposes, the uniform taper of transition zone surface 46 extends to supported end 56 of the ironing mandrel. In accordance with the invention, this uniform taper extends beyond the formed can body height providing advantages in stripping means contact and avoiding the "tearing-off" of edge metal.

This uniformly tapered configuration of the transition zone surface 46 of ironing mandrel 38 differs significantly from prior mandrel structures in which a cylindrical "dwell" configuration was provided above the trim height plane. Also, the resulting ironing process differs due to the configuration of transition zone 46. In prior practice, "tearing-off" of sheet metal at the open end of a can body occurred unless "ironing" continued while metal existed between the mandrel and the final ironing ring; i.e. unless the metal was under compression against the mandrel as the sidewall metal expired the open end would be damaged. With the uniform taper of transition zone 46, ironing can terminate slightly before the sidewall metal expires. Because of the gradual thickening of the flanging metal being formed and because of the dimensional relationships, a peripheral gap can be formed between the tapered transition zone surface 46 and the interior surface of the can body without causing tearing-off of metal.

As a part of the invention, when the ironing mandrel 38 is retracted, stripping fingers initially come into contact with, and move longitudinally along a portion of, transition zone surface 46 which is of a smaller diameter than the diameter of the mandrel at the open edge of the formed can body.

In the detailed presentation of a can body of FIGS. 2, 3, and 4, the cross-sectional configuration of the formed can body is shown with its thickness exaggerated to assist in explanation of the invention. The bottom wall of profile 32 will have a thickness substantially equal to the starting material gage of the sheet metal prior to drawing and ironing.

A major portion 58 of the can body sidewall is formed by ironing along the main body portion 42 of ironing mandrel 38; this constitutes the "thin wall" portion of the can body 34. The "thin wall" gage in the reverse taper embodiment occurs at the largest diameter dimension (plane 40). The sidewall thickness established at the start (plane 48) of transition zone 46 can be slightly greater (less than 10%) than that established at plane 40.

Flanging metal is established in transition zone 46 during ironing. A substantial increase in the sidewall thickness, over the thin-wall gage of main body portion 58, is provided uniformly over a relatively short longitudinal distance as flanging metal portion 60 is formed. Flanging metal thickness of about 0.006" at trim height is provided for lightweight flat rolled steel can bodies.

During ironing, excess sidewall metal to be trimmed extends beyond trim line plane 50 and expires within transition zone 46. Such excess metal portion 62 presents laterally disposed top edge surface 64.

An important aspect of the invention is avoiding trimmed metal wastage through selection of the angle of taper for transition zone surface 46. The object is to locate an optimum amount of metal within the flanging metal portion 60 to improve flanging metal characteristics while providing for sidewall metal to expire in transition zone 46 within the minimum practical height desired to provide for uniform trimming.

Excess metal 62 is trimmed from the can body after removal from the ironing mandrel. During ironing, as the sidewall metal expires, edge metal surface 64 is presented at plane 66 in longitudinally spaced relationship from the plane of supported end 56. The mechanical stripping means will move along transition zone surface 46 in approaching top edge surface 64. During such approach, transition zone surface 46 has a smaller diameter than the internal diameter of the untrimmed open end of the formed can body.

In practice, a slight peripheral gap 68 (FIGS. 2 and 4) can occur between the open end interior diameter surface of the formed can body and the tapered transition zone surface 46 as ironing terminates and sidewall metal expires shortly thereafter.

To allow for uniform trimming, trim metal 62 should, preferably, have a height of at least $\frac{1}{8}$" for a twelve-ounce beverage container can body having a trim height of $4\frac{7}{8}$"; but, can have a greater height such as $\frac{1}{4}$" or $\frac{3}{8}$".

It should be noted however that the tapered transition zone surface 46 and results produced by the described arrangement facilitate stripping and substantially eliminate "roll-back" of edge metal; this, in turn, reduces trim height requirements over those of the prior art where an excess trim height was sometimes relied on to allow for roll-back damage while attempting to avoid damage to the can body at the trim height.

Adequate contact surface is provided at edge 64 which is slightly thicker than trim height metal. The approach of the stripping fingers along a surface of the mandrel which is "inside" of (i.e. of smaller diameter than) the interior diameter of the formed can body at its open end also facilitates stripping.

The relationship of several differing diameter portions of ironing mandrel 38 is shown by broken line extensions from such portions toward the supported end of the mandrel in FIG. 2. The largest diameter of the mandrel which is located at plane 40 is represented by line 70. The diameter at plane 48, where formation of flanging metal starts, is shown by line 72; the diameter at plane 66 where sidewall metal expires is represented by line 74; and the smallest diameter portion of transition zone 46 is shown by line 75.

Representative values for a drawn and ironed can body formed from lightweight flat rolled sheet metal for a twelve fluid ounce beverage container are shown in the following table:

TABLE I

| Location in FIG. 2 | Wall Thickness 85# Steel Plate | Aluminum Plate | Height |
|---|---|---|---|
| Bottom wall | .0094" | .0135" | 0 |
| Plane 40 (thin wall gage) | .0033" | .0050" | .625" |
| Plane 48 | .0036" | .0054" | 4.150" |
| At trim line plane 50 (thick wall) | .0059" | .0084" | 4.875" |
| At edge 64 | .0061" | .0090" | 5.00" (minimum) |

With the invention, steel plate of about 85#/bb, i.e. less than about 95#/bb to about 80#/bb, can be used for drawing and ironing can bodies for pressurized beverage containers. No special properties are required in the steel; the standard can stock, "T-4" material, produced by a single cold reduction to starting gage following a continuous anneal, can be used. Standard can stock aluminum can also be used. Adequate sidewall strength can be provided with a "thin wall" gage of less than 0.0033", to about 0.003", with steel. A thin wall thickness of about 0.005" would generally be required for aluminum plate of the type utilized in the past for beverage containers.

In practice of the invention with the ironing mandrel of FIG. 2, three ironing rings of progressively smaller internal diameter are utilized as shown in FIG. 3. The interior diameter of the final ironing ring is substantially equal to the final exterior diameter of the can body 34.

The teachings of the invention include a mathematical relationship between ironing mandrel dimensions and can body wall thickness at the penultimate and the last ironing rings which provides for expiration of ironing metal as desired in transition zone 46. Sufficient metal is provided after passage of the penultimate ironing ring and before passage through the final ring to provide for increased wall thickness (flanging metal) at the trim height and to have sidewall metal expire in the tapered transition zone 46. More specifically, the invention provides for maximizing available metal in the flanging portion 60 (FIG. 2) of the trimmed can body while providing for the sidewall metal to expire in transition zone 46 within an optimum height to provide for uniform height trimming.

In accordance with the invention, the reduction in wall thickness in the last ironing ring is selected to be approximately equal to but no less than the difference in sidewall thickness in the main body portion of the can body and the sidewall thickness where metal expires in the transition zone 46. In this way, sufficient metal to form flanging metal with desired thick-wall dimension at the trim height and to allow for uniform trimming is provided.

The dimensional relationship of ironing mandrel and ironing ring diameters is shown in FIG. 3 (in which the same reference numerals are used for parts corresponding to those of FIG. 2). In FIG. 3, original thickness of the cup sidewall is indicated at 80. This sidewall thickness is progressively reduced, as shown, during passage through first ironing ring 82, second (penultimate) ironing ring 84 and third (final) ironing ring 86.

The reduction in wall thickness in the final ring 86 is indicated at 88. Half the difference between the largest diameter (line 70, FIG. 2) of mandrel 38 and the diameter of the mandrel in the transition zone where metal expires (line 74) is shown at 90 of FIG. 3. In the preferred embodiment, the reduction in sidewall thickness indicated at 88 (i.e. the reduction in the last ironing ring) is at least half the diameter difference value (indicated at 90) between the largest diameter portion of the mandrel (at plane 40 represented by line 70 in FIG. 2) and the diameter in the transition zone 46 where metal expires (at plane 66 represented by line 74 in FIG. 2). Stated otherwise, the amount of reduction provided in the last ironing ring is at least equal to the difference in sidewall thickness between the thin-wall thickness and the sidewall thickness where the metal expires. In practice, the sidewall is reduced about 45% in the final ironing ring; e.g., with 85#/bb flat rolled steel, the main body sidewall has a thickness around 0.0061" after passage through the penultimate ring and before passage through the final ring.

The enlarged view of FIG. 4 (which uses the same reference numbers for corresponding parts as FIGS. 2 and 3) illustrates a portion of the mandrel 38 on a return stroke for purposes of showing the action of the stripping means in removing the ironed can body from the mandrel. One stripping finger is illustrated; in practice, stripping fingers are distributed about the periphery (e.g. as shown in U.S. Pat. No. 4,095,452) and are spring urged toward the central longitudinal axis 44 of the mandrel 38. Pivotal mounting and pivotal spring-urged action of the stripping fingers is facilitated because of the mandrel surface contact relationships described above.

After passage through the ironing rings, the formed can body 34 is carried by mandrel 38 during its work stroke beyond stripping finger 92. Surface 94 of stripping finger 92 initially contacts transition zone surface 46 above edge 64 of the formed can body at a smaller diameter portion of transition zone 46 than that at 66 where sidewall metal expires. Laterally extending surface 96 of stripping finger 92 is provided for contact with edge 64 of the formed can body.

On the return stroke as indicated, the relative longitudinally directed movement between the stripping fingers and the mandrel brings the edge 64 of the can body 34 into contact with surface 96 of stripping finger 92; the latter is shown in broken lines as such contact is about to occur.

Note that, as the stripping finger contacts can body edge 64, corner 98, at the intersection of surfaces 94 and 96 of stripping finger 92, is "inside" of the top edge of the can body in contact with a smaller diameter portion of the mandrel than the interior diameter of the can body at the open end of the can body regardless of whether or not a gap is formed. Gap 68 between the inside diameter of the can body and the tapered surface 46 can occur when sidewall metal expires shortly after ironing terminates rather than as ironing terminates in the work stroke.

Advantages and contributions of the invention described above largely in relation to flat rolled steel are similarly available in drawing and ironing of aluminum where starting thickness gages are increased approximately 30% over those of flat rolled steel.

While specific materials and specific configurations for ironing rings and stripping means have been set forth for purposes of describing a specific embodiment, it is to be understood that other selections are available to those skilled in the art in the light of the above teachings. Therefore, the scope of the present invention is to be determined by reference to the accompanying claims.

What is claimed is:

1. Structure for forming lightweight flat-rolled sheet metal into a unitary can body having a closed bottom wall and an elongated sidewall defining an open end longitudinally opposite to the closed bottom wall, the elongated sidewall of such unitary can body being formed by ironing in which sidewall metal of a seamless unitary cup-shaped article, having an open end and a closed end, is reduced in thickness and elongated by passage of the cup-shaped article through a plurality of ironing rings, comprising an elongated, plunger-type ironing mandrel, such mandrel including a work input end adapted to be supported by machine structure for providing ironing force, a central longitudinal axis, an external sidewall radially spaced from the central longitudinal axis so as to present a substantially circular configuration in a plane perpendicular to the central longitudinal axis, and a terminal end longitudinally opposite to the work input end, such terminal end defining a bottom wall configuration for contacting the interior surface at the closed end of the cup-shaped article, the external sidewall of such ironing mandrel presenting a preselected surface configuration for formation of the can body sidewall during ironing, the configuration of such mandrel external sidewall surface being preselected along its longitudinal length from a location contiguous to the terminal end to a predetermined location contiguous to the work input end of such mandrel, such preselected configuration sidewall surface including a main body portion extending over a major portion of the longitudinal length of such mandrel from its terminal end toward its work input end, and a transition zone extending longitudinally from such main body portion toward the work input end, the exterior sidewall surface of the ironing mandrel transition zone presenting a uniformly tapered surface extending longitudinally of the ironing mandrel, the tapering of such transition zone surface being such that the exterior diameter of the ironing mandrel beyond the main body portion and extending in the direction of the work input end is uniformly decreased in relation to a main body portion of the ironing mandrel which presents the largest diameter dimension of the preselected surface configuration of the ironing mandrel, a trim height plane which is perpendicular to the central longitudinal axis of the mandrel establishes a location along the length of the ironing mandrel corresponding to the desired height of an ironed can body after trimming subsequent to ironing and stripping of the formed can body from the mandrel, the transition zone tapered surface being located at such trim height plane and extending in longitudinally opposite directions from such trim height plane, the transition zone tapered surface having a predetermined angular relationship to the central longitudinal axis of the ironing mandrel, such predetermined angular relationship and location of such transition zone surface being selected such that:

the sidewall of a can body being ironed has a greater thickness than the main body portion sidewall thickness in approaching such trim height plane to provide desired flanging metal thickness at the trim height plane, and ironing of the can body sidewall extends beyond such trim height plane so that sidewall metal expires along such transition zone tapered surface beyond the trim height plane in the longitudinal direction of the work input end of the mandrel so as to present edge metal at the open end of the ironed can body of a thickness greater than that of sidewall metal at the trim height plane, such edge metal being presented at a location where such transition zone continues establishing a tapered exterior mandrel contact surface extending toward the work input end of the mandrel, such contact surface being of smaller diameter than that existing at the edge metal location.

2. The structure of claim 1 in which the configuration of the transition zone tapered surface is such that sidewall thickness at the trim height plane is at least about forty percent greater than sidewall thickness of the ironed can body at the largest diameter location of the main body portion of the mandrel.

3. In combination with the structure of claim 1 stripper means for mechanically assisting removal of an ironed can body from the ironing mandrel by applying longitudinally directed stripping force to the ironed can body at its open end edge located beyond the trim height plane in the direction of the work input end of the mandrel, such stripper means including can body contact surface means disposed in transverse relationship to the central longitudinal axis of the mandrel so as to contact edge metal at the open end of an ironed can body, and mandrel contact surface means to be urged into contact with the mandrel along its preselected configuration external sidewall surface, the mandrel contact surface means contacting such mandrel surface prior to edge metal contact by the can body contact surface means of the stripper means, in such transition zone portion extending toward the work input end of the mandrel where mandrel diameter is less than the interior diameter of a mandrel-mounted ironed can body at its open end.

4. The structure of claim 2 in which such largest diameter dimension of the main body portion of the mandrel is located contiguous to the terminal end of the ironing mandrel and the main body portion of the mandrel converges slightly toward the central longitudinal axis over at least a portion of its length between the location of such largest diameter dimension and start of the transition zone.

5. The structure of claim 2 in which the largest diameter dimension of the main body portion of the sidewall ironing surface of the mandrel is located contiguous to the terminal end of the mandrel and the surface configuration of the main body portion of the ironing mandrel converges slightly toward the central longitudinal axis of the ironing mandrel along a major portion of its length between such largest diameter dimension and start of the transition zone, the angle of convergence of the exterior sidewall surface of the main body portion of the mandrel being substantially less than the angle of taper of the transition zone such that sidewall thickness established in the main body portion at the start of the transition zone is less than ten percent greater than the sidewall thickness at such largest diameter dimension of the mandrel.

6. The structure of claim 1 including in combination a plurality of female ironing rings for receiving the elongated plunger-type mandrel, each such ironing ring presenting an interior ironing surface which is coaxial with the central longitudinal axis of such ironing mandrel, the ironing surface of each successive ring contacted during a working stroke of such ironing mandrel being of smaller diameter to provide a progressive reduction in exterior diameter of a can body being ironed during passage while mounted on such ironing mandrel through each successive ring, with the final external diameter of an ironed sidewall can body being established by the internal diameter of the final ironing ring, the reduction in exterior diameter of a can body during passage through such final ironing ring and the dimensional configuration of the ironing mandrel being interrelated such that the reduction in exterior diameter of a can body provided by passage through the final ring which completes ironing is at least equal to the difference between sidewall metal thicknesses of the ironed can body established at its open end and at the start of the transition zone.

7. The structure of claim 6 for use in ironing flat-rolled steel having a weight prior to ironing of about eighty-five pounds per base box to produce an ironed sidewall can body having a sidewall thickness after ironing in the main body portion of the can body at the largest diameter dimension of such mandrel of about 0.0033", in which the transition zone surface between the main body portion and the trim height plane has a longitudinal length of about 0.725" and a taper to establish a sidewall thickness which is at least 0.0025" greater at trim height than the sidewall thickness established at the largest diameter dimension of the main body portion of such mandrel.

8. The structure of claim 6 for use in ironing flat-rolled aluminum having a thickness gage prior to ironing of about 0.0135" to produce an ironed sidewall can body having a sidewall thickness in the main body portion of the can body at the largest diameter dimension of such mandrel of about 0.005" after ironing, in which the transition zone surface between the main body portion and the trim height plane has a longitudinal length of about 0.725" and a taper to establish a sidewall thickness which is about 0.0035" greater at trim height than the sidewall thickness established at the largest diameter dimension of the main body portion of such mandrel.

* * * * *